US008043393B2

(12) United States Patent
Querel et al.

(10) Patent No.: US 8,043,393 B2
(45) **Date of Patent: *Oct. 25, 2011**

(54) BONDED ABRASIVE ARTICLE AND METHOD OF MAKING

(75) Inventors: Gilles Querel, Worcester, MA (US); Paul S. Dando, Rudford Glos (GB); Cecile Jousseaume, Paris (FR); Richard W. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 513 days.

This patent is subject to a terminal disclaimer.

(21) Appl. No.: 12/048,130

(22) Filed: Mar. 13, 2008

(65) Prior Publication Data

US 2008/0222967 A1 Sep. 18, 2008

Related U.S. Application Data

(60) Provisional application No. 60/894,871, filed on Mar. 14, 2007.

(51) Int. Cl.
*C09K 3/14* (2006.01)

(52) U.S. Cl. ..... 51/308; 51/307; 51/309

(58) Field of Classification Search ..... 51/307, 51/308, 309

See application file for complete search history.

(56) References Cited

U.S. PATENT DOCUMENTS

| | | | | |
|---|---|---|---|---|
| 4,260,397 | A * | 4/1981 | Bovenkerk | 51/307 |
| 5,095,665 | A | 3/1992 | Nagata et al. | |
| 5,106,392 | A | 4/1992 | Slutz et al. | |
| 5,139,537 | A | 8/1992 | Julien | |
| 5,211,726 | A | 5/1993 | Slutz et al. | |
| 5,300,129 | A | 4/1994 | Clark | |
| 5,318,605 | A | 6/1994 | Carman | |
| 5,328,875 | A | 7/1994 | Ueda et al. | |
| 5,466,642 | A | 11/1995 | Tajima et al. | |
| 5,607,489 | A | 3/1997 | Li | |
| 6,123,743 | A | 9/2000 | Carman et al. | |
| 6,123,744 | A | 9/2000 | Huzinec | |
| 6,679,758 | B2 * | 1/2004 | Bright et al. | 451/28 |
| 6,702,650 | B2 | 3/2004 | Adefris | |
| 6,790,126 | B2 | 9/2004 | Wood et al. | |
| 6,802,878 | B1 | 10/2004 | Monroe | |
| 2004/0185754 | A1 * | 9/2004 | Adefris et al. | 451/28 |
| 2005/0101225 | A1 * | 5/2005 | Bright et al. | 451/28 |
| 2006/0021285 | A1 | 2/2006 | Rosenflanz et al. | |
| 2006/0160476 | A1 | 7/2006 | Bright et al. | |

FOREIGN PATENT DOCUMENTS

| | | | |
|---|---|---|---|
| EP | 0571865 | A | 12/1993 |
| EP | 0577375 | A1 | 1/1994 |
| EP | 0946332 | B1 | 10/1999 |
| EP | 1100654 | B1 | 5/2001 |
| JP | 6211542 | | 8/1994 |
| JP | 2003-205466 | A | 7/2003 |
| WO | 89/02344 | A | 3/1989 |
| WO | 01/70463 | A | 9/2001 |
| WO | 2008/112914 | A1 | 9/2008 |

OTHER PUBLICATIONS

Yang, J. et al., "Effect of Glass Composition on the Strength of Vitreous Bonded c-BN Grinding Wheels," Ceramics International, vol. 19, pp. 87-92, 1993.

Yokogawa, M., et al., "Effects of the Abrasive Retention of CBN Wheels on Grinding Performance," Bull. Japan Soc. of Prec. Engg., vol. 20, No. 4, pp. 231-238, Dec. 1986.

* cited by examiner

*Primary Examiner* — Elizabeth Wood

(74) *Attorney, Agent, or Firm* — Abel Law Group, LLP; Joseph P. Sullivan

(57) ABSTRACT

A bonded abrasive article is provided that includes abrasive grains within a bond matrix, the abrasive grains including cubic boron nitride (cBN) and the bond matrix including a polycrystalline ceramic phase. The bonded abrasive may have a Modulus of Rupture (MOR) of not less than about 40 MPa. Certain embodiments may have porosity, such as greater than about 5.0 vol %.

11 Claims, 6 Drawing Sheets

BONDED ABRASIVE ARTICLE AND METHOD OF MAKING

CROSS-REFERENCE TO RELATED APPLICATION(S)

The present application claims priority from U.S. Provisional Patent Application No. 60/894,871, filed Mar. 14, 2007, entitled "BONDED ABRASIVE ARTICLE AND METHOD OF MAKING", naming inventors Gilles Querel, Paul S. Dando, Cecile Jousseaume, and Richard W. Hall, which application is incorporated by reference herein in its entirety.

BACKGROUND

1. Field of the Disclosure

The present disclosure is directed to bonded abrasive articles and particularly directed to bonded abrasive articles having a crystalline bond matrix.

2. Description of the Related Art

Abrasives are generally utilized in various machining operations, ranging from fine polishing to bulk material removal and cutting. For example, free abrasives composed of loose particles are used in slurries for polishing applications such as chemical mechanical polishing (CMP) in the semiconductor industry. Alternatively, abrasives can be in the form of fixed abrasive articles such as bonded and coated abrasives which can include devices such as grinding wheels, belts, rolls, disks and the like.

Fixed abrasives generally differ from free abrasives in that fixed abrasives utilize abrasive grains or grit within a matrix of material that fixes the position of the abrasive grains relative to each other. Common fixed abrasive grits can include alumina, silicon carbide, various minerals such as garnet, as well as superabrasives such as diamond and cubic boron nitride (cBN). In particular reference to bonded abrasive articles, the abrasive grits are fixed in relation to each other in a bond material. While many different bond materials can be used, vitrified bond materials, such as an amorphous phase glass materials are common. However, performance properties of conventional bonded abrasives such as, for example aluminum oxide, silicon carbide, diamond, and cubic boron nitride having vitrified bonds are limited by the nature of the bond and the composition of the abrasive grains. Notably, the bond between the bond matrix and the abrasive grains can be insufficient such that during grinding the abrasive grains are easily removed from the bond matrix, reducing the effectiveness of the grinding or polishing process.

The industry continues to need bonded abrasives having improved properties. Properties of interest include mechanical stability, strength, operable lifetime, and improved grinding performance.

SUMMARY

According to a first aspect a bonded abrasive is provided which includes abrasive grains including cubic boron nitride (cBN) in a bond matrix. The bond matrix includes a polycrystalline ceramic phase. The bonded abrasive has a porosity of not less than about 5.0 vol % and a modulus of rupture (MOR) of not less than about 40 MPa.

According to a second aspect a bonded abrasive is provided which includes abrasive grains including cubic boron nitride (cBN) in a bond matrix that includes a polycrystalline ceramic phase. The bonded abrasive has a porosity of not less than about 20 vol % and a modulus of rupture (MOR) of not less than about 30 MPa.

According to another aspect, a method is provided which includes providing a glass powder, and combining the glass powder with abrasive grains that include cubic boron nitride to form a mixture. The method further includes forming the mixture to form a green article, and sintering the green article at a temperature of not less than about 1200° C. to form a bonded abrasive comprising abrasive grains within a bond matrix. The bond matrix includes not less than about 50 vol % of a polycrystalline ceramic phase.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE EMBODIMENT(S)

Figure 1:
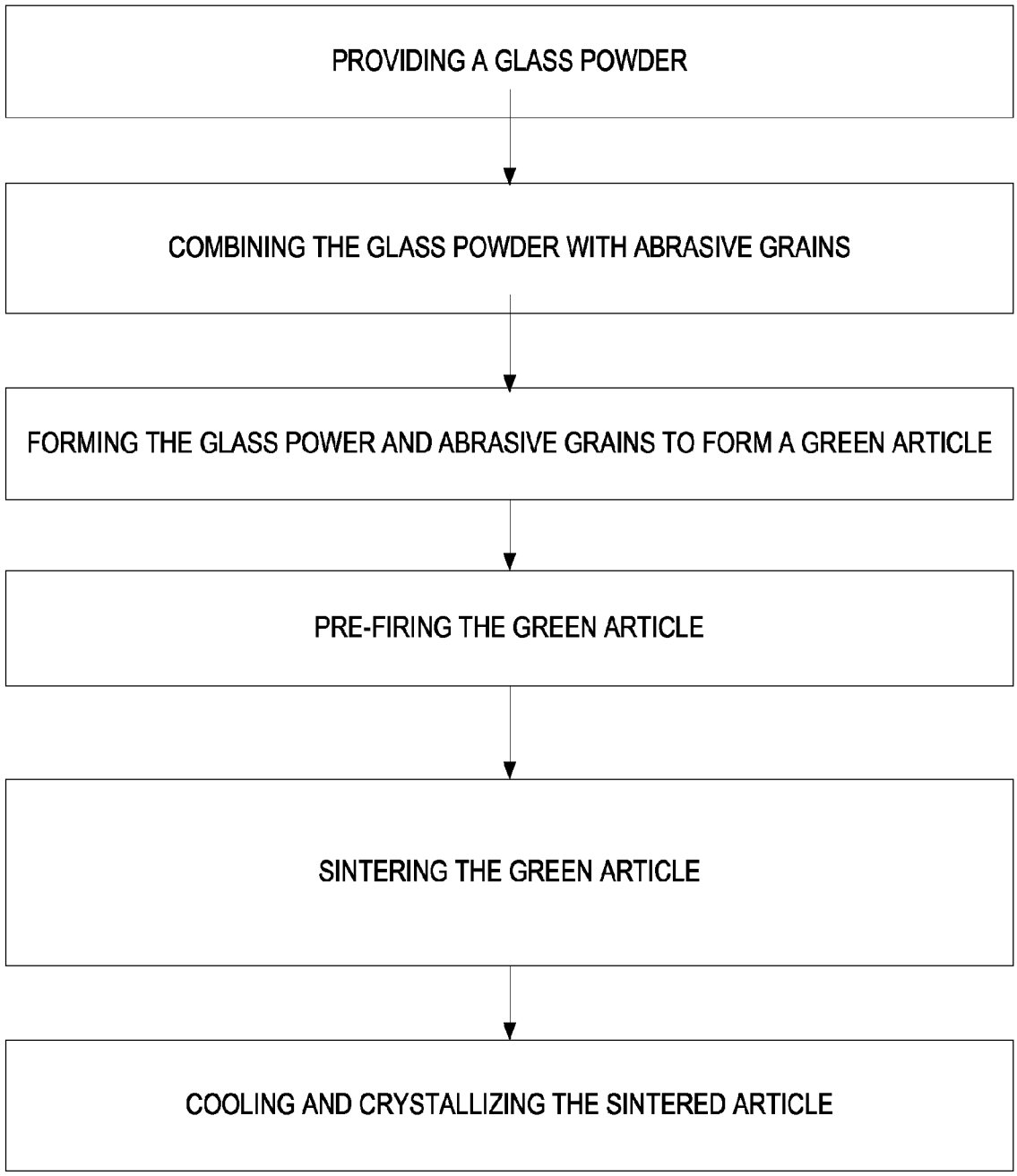
FIG. 1 is a flow chart illustrating a process for forming a bonded abrasive according to one embodiment.

Referring to FIG. 1, a flow chart is provided illustrating a process by which a bonded abrasive is formed according to one embodiment. The process is initiated at step 101 by providing a glass powder. The powder is generally glassy (amorphous), such that not less than about 80 wt % of the glass is amorphous phase. According to a particular embodiment, the glass powder can include a greater content of amorphous phase, such as not less than about 90 wt %, or even not less than about 95 wt % amorphous phase. Generally, formation of a glass powder can be completed by mixing a suitable proportion of raw materials and melting the mixture of raw materials to form a glass at high temperatures. After sufficient melting and mixing of the glass, the glass can be cooled (quenched) and crushed to a powder.

Generally, the glass powder can be further processed, such as by a milling process, to provide a glass powder having a suitable particle size distribution. Typically, the glass powder has an average particle size of not greater than about 100 microns. In a particular embodiment, the glass powder has an average particle size of not greater than 75 microns, such as not greater than about 50 microns, or even not greater than about 10 microns. However, the average particle size of the glass powder is typically within a range of between about 5.0 microns and about 75 microns.

The composition of the glass powder can be described using the equation $aM_2O$-bMO-$cM_2O_3$-$dMO_2$. As illustrated by the equation, the glass powder composition can include more than one metal oxide, such that the oxides are present together as a compound oxide material. In one particular embodiment, the glass includes metal oxide compounds having monovalent cations (1+), such as those metal oxide compounds represented by the generic formula $M_2O$, Suitable metal oxide compositions represented by $M_2O$ can include compounds such as $Li_2O$, $Na_2O$, $K_2O$, and $Cs_2O$.

According to another embodiment, and as provided in the general equation, the glass powder can include other metal oxide compounds. In particular, the glass powder can include metal oxide compounds having divalent cations (2+), such as those metal oxide compounds represented by the generic formula MO. Suitable metal oxide compositions represented by MO can include compounds such as MgO, CaO, SrO, BaO, and ZnO.

Additionally, the glass powder can include metal oxide compounds having trivalent cations (3+), particularly those metal oxide compounds represented by the generic formula $M_2O_3$. Suitable metal oxide compositions represented by $M_2O_3$ can include compounds such as $Al_2O_3$, $B_2O_3$, $Y_2O_3$, $Fe_2O_3$, $Bi_2O_3$, and $La_2O_3$.

Notably, as indicated in the general equation above, the glass powder can include metal oxide compounds having cations of a 4+ valence state, as represented by $MO_2$. As such, suitable $MO_2$ compositions can include $SiO_2$, $TiO_2$, and $ZrO_2$.

In further reference to the composition of the glass powder represented by the generic equation $aM_2O$-bMO-$cM_2O_3$-$dMO_2$-$eM_2O_5$, the coefficients (a, b, c, d, and e) are provided to indicate the amount (in mol%) of each of the different types of metal oxide compounds ($M_2O$, MO, $M_2O_3$, $MO_2$, and $M_2O_5$) that can be present within the glass powder. As such, coefficient "a" generally represents the total amount of the $M_2O$ metal oxide compounds within the glass powder. The total amount (mol fraction) of $M_2O$ metal oxide compounds within the glass powder is generally within a range between about $0 \leqq a \leqq 0.30$. According to a particular embodiment, the amount of $M_2O$ metal oxide compounds within the glass powder is within a range between about $0 \leqq a \leqq 0.15$, and more particularly within a range of about $0 \leqq a \leqq 0.10$.

In reference to the presence of MO metal oxide compounds containing a divalent cation $M^{2+}$, the total amount (mol fraction) of such compounds can be defined by the coefficient "b". Generally, the total amount of MO metal oxide compounds within the glass powder is within a range between about $0 \leqq b \leqq 0.60$. According to a particular embodiment, the amount of MO metal oxide compounds is within a range between about $0 \leqq b \leqq 0.45$, and more particularly within a range between about $0.15 \leqq b \leqq 0.35$.

Additionally, the amount of $M_2O_3$ metal oxide compounds containing a trivalent cation $M^{3+}$ within the glass powder are represented by the coefficient "c". As such, the total amount (mol fraction) of $M_2O_3$ oxide compounds is generally within a range of between about $0 \leqq c \leqq 0.60$. According to one particular embodiment, the amount of $M_2O_3$ metal oxide compounds within the glass powder are within a range between about $0 \leqq c \leqq 0.40$, and more particularly within a range between about $0.10 \leqq c \leqq 0.30$.

The amount of $MO_2$ metal oxide compounds containing a $M^{4+}$ cation as described in the general equation $aM_2O$-bMO-$cM_2O_3$-$dMO_2$-$eM_2O_5$ are represented by the coefficient "d". Generally, the total amount (mol fraction) $MO_2$ oxide compounds within the glass powder are within a range of between about $0.20 \leqq d \leqq 0.80$. In one particular embodiment, the amount of $MO_2$ metal oxide compounds within the glass powder is within a range between about $0.30 \leqq d \leqq 0.75$, and more particularly within a range between about $0.40 \leqq d \leqq 0.60$.

In particular reference to $MO_2$ metal oxide compounds, particular embodiments utilize a glass powder that includes silicon oxide ($SiO_2$) such that the glass powder is a silicate-based composition. In particular reference to only the presence of silicon oxide within the glass powder, typically the glass powder includes not greater than about 80 mol % silicon oxide. According to another embodiment, the glass powder includes not greater than about 70 mol %, or even not greater than about 60 mol % silicon oxide. Still, in particular embodiments, the amount of silicon oxide in the glass powder is not less than about 20 mol %. As such, the amount of silicon oxide in the glass powder is generally within a range of between about 30 mol % and about 70 mol %, and particularly within a range between about 40 mol % and about 60 mol %.

In further reference to $M_2O_3$ metal oxide compounds, certain compositions of the glass powder include aluminum oxide ($Al_2O_3$) particularly in addition to silicon oxide, such that the glass powder is an aluminum silicate. As such, in particular reference to only the presence of aluminum oxide, generally the glass powder includes not greater than about 60 mol % $Al_2O_3$. In other embodiments, the glass powder can include aluminum oxide in lesser amounts, such as not greater than about 50 mol %, or even not greater than about 40 mol %. Typically, the glass powder incorporates aluminum oxide within a range between about 5.0 mol % to about 40 mol %, and particularly within a range between about 10 mol % and about 30 mol %.

According to a particular embodiment, the glass powder includes at least one of magnesium oxide and lithium oxide in addition to silicon oxide, and more particularly in addition to silicon oxide and aluminum oxide. As such, the amount of magnesium oxide within the glass powder is generally not greater than about 45 mol %, such as not greater than 40 mol %, or even, not greater than 35 mol %. Typically, the glass powder compositions having magnesium oxide, utilize an amount within a range between about 5 mol % and about 40 mol %, and particularly within a range between about 15 mol % and about 35 mol %. Magnesium-containing aluminum silicate glasses may be referred to as MAS glasses having a magnesium aluminum silicate composition.

According to another embodiment, the glass powder includes lithium oxide. As such, the amount of lithium oxide within the glass powder is generally not greater than about 45 mol %, such as not greater than 30 mol %, or even, not greater than 20 mol %. Typically, the glass powder compositions having lithium oxide, utilize an amount within a range between about 1.0 mol % and about 20 mol %, and particularly within a range between about 5.0 mol % and about 15 mol %. Lithium-containing aluminum silicate glasses may be referred to as LAS glasses having a lithium aluminum silicate composition.

In other embodiments, the glass powder particularly includes barium oxide. As such, the amount of barium oxide within the glass powder is generally not greater than about 45 mol %, such as not greater than 30 mol %, or even, not greater than 20 mol %. Typically, the glass powder compositions having barium oxide, utilize an amount within a range between about 0.1 mol % and about 20 mol %, and more particularly within a range between about 1.0 mol % and about 10 mol %. Barium-containing aluminum silicate glasses may be referred to as BAS glasses having a barium aluminum silicate composition.

In other embodiments, the glass powder includes calcium oxide. As such, the amount of calcium oxide within the glass powder is generally not greater than about 45 mol %, such as not greater than 30 mol %, or even, not greater than 20 mol %. Typically, the glass powder compositions having calcium oxide utilize an amount within a range between about 0.5 mol % and about 20 mol %, and particularly within a range between about 1.0 mol % and about 10 mol %. In some embodiments, calcium oxide is present in systems utilizing other metal oxide compounds mentioned above, notably in combination with the MAS or BAS glasses. The calcium oxide can form a compound oxide, for example a calcium magnesium aluminum silicate (CMAS) or calcium barium magnesium aluminum silicate (CBAS).

As described above, the glass compositions can include other metal oxide compounds. According to a particular embodiment, the glass powder composition includes boron oxide. Generally, the amount of boron oxide within the glass powder is not greater than about 45 mol %, such as not greater than 30 mol %, or even, not greater than 20 mol %. Typically, the glass powder compositions having boron oxide utilize an amount within a range between about 0.5 mol % and about 20 mol %, and particularly within a range between about 2.0 mol % and about 10 mol %.

In another particular embodiment, the glass powder can include other metal oxides, as described above, such as for example, $Na_2O$, $K_2O$, $Cs_2O$, $Y_2O_3$, $Fe_2O_3$, $Bi_2O_3$, $La_2O_3$, SrO, ZnO, $TiO_2$, $P_2O_5$, and $ZrO_2$. Such metal oxides can be added as modifiers to control the properties and processability of the glass powder and the resulting bond matrix. Typically, such modifiers are present in the glass powder in an amount of not greater than about 20 mol %. According to another embodiment, such modifiers are present in the glass powder in an amount of not greater than about 15 mol %, such as not greater than about 10 mol %. Typically, glass powder compositions with modifiers utilize an amount within a range between about 1.0 mol % and about 20 mol %, and more particularly within a range between about 2.0 mol % and about 15 mol %.

After providing the glass powder at step 101, the process continues at step 103 by combining the glass powder with abrasive grains to form a mixture. In reference to the composition of the mixture, generally the mixture includes not less than about 25 vol % abrasive grains. According to a particular embodiment, the mixture includes not less than about 40 vol % abrasive grains, such as not less than about 45 vol %, or even not less than about 50 vol % abrasive grains. Still, the amount of abrasive grains is limited such that the mixture generally includes not greater than about 60 vol % abrasive grains. In particular, the abrasive grains within the mixture are generally present in an amount within a range between about 30 vol % and about 55 vol %.

In reference to the abrasive grains, generally the abrasive grains include hard, abrasive materials, and particularly include superabrasive materials. According to a particular embodiment, the abrasive grains are superabrasive grains, such that they are either diamond or cubic boron nitride (cBN). In a particular embodiment, the abrasive grains include cubic boron nitride, and more particularly, the abrasive grains consist essentially of cubic boron nitride.

The abrasive grains generally have an average grain size of not greater than about 500 microns. Particularly, the average grain size of the abrasive grains is not greater than about 200 microns, or even not greater than about 100 microns. Generally, the average grain size is within a range of between about 1.0 microns and about 250 microns, and particularly within a range of between about 35 microns and about 180 microns.

According to one embodiment, the abrasive grains have a major component of cubic boron nitride. In certain embodiments, a certain percentage of the abrasive grains which generally are otherwise cubic boron nitride can be replaced with substitute abrasive grains, such as aluminum oxide, silicon carbide, boron carbide, tungsten carbide, and zirconium silicate. As such, the amount of substitute abrasive grains is generally not greater than about 40 vol % of the total abrasive grains, such as not greater than about 25 vol %, or even not greater than about 10 vol %.

In reference to the amount of glass powder combined with the abrasive grains in the mixture, the mixture can include not less than about 10 vol % glass powder, such as not less than about 15 vol % glass powder. Still, the amount of glass powder is limited, such that the mixture includes not greater than about 60 vol % glass powder, such as not greater than about 50 vol % glass powder, or even not greater than about 40 vol % glass powder. In particular, the mixture generally includes an amount of glass powder within a range between about 10 vol % and about 30 vol %.

The mixing process can include a dry mix process or a wet mix process. Particularly, the mixing process includes a wet mix process, such that at least one liquid is added to facilitate mixing of the glass powder and abrasive grains. According to a particular embodiment, the liquid is water. In such embodiments, water is added in an amount suitable to facilitate adequate mixing and as such, the mixture generally contains at least about 6.0 vol % water, such as at least about 10 vol %. Still, the mixture generally includes not greater than about 20 vol % water, such as not greater than about 15 vol % water.

The mixture can include other additives, such as a binder. Generally, the binder is an organic material. Suitable binder materials can include organic materials containing glycol (e.g., polyethylene glycol), dextrin, resin, glue, or alcohol (e.g., polyvinyl alcohol), or combinations thereof. Generally, the mixture includes not greater than about 15 vol % of a binder, such as not greater than about 10 vol %. According to one particular embodiment, the binder is provided in the mixture within a range between about 2.0 vol % and about 10 vol %.

In further reference to other additives, the mixture can include pore formers or a pore inducing material to facilitate formation of a porous final bonded abrasive structure. Accordingly, pore formers generally include inorganic or organic materials. Typically suitable organic materials can include polyvinyl butyrate, polyvinyl chloride, wax (e.g., polyethylene wax), plant seeds, plant shells, sodium diamyl sulfosucanate, methyl ethyl ketone, naphthalene, polystyrene, polyethylene, polypropylene, acrylic polymers, p-dichlorobenzene, and combinations thereof. Such pore formers are typically provided in a particulate form such that upon heating the particulate material is evolved and a pore is left behind. Accordingly, the pore former has an average particulate size of not greater than about 0.5 mm, or even not greater than about 0.05 mm. Moreover, suitable inorganic materials can include beads of inorganic material, particularly hollow spheres of such materials as glasses, ceramics or glass-ceramics, or combinations thereof.

Typically, the amount of the pore former provided in the mixture is not greater than about 35 vol %. In another embodiment, the mixture includes not greater than about 30 vol % of the pore former, such as not greater than about 20 vol %, or even not greater than about 15 vol % of the pore former.

According to a particular embodiment, the mixture includes an amount of pore former in a range of between about 1.0 vol %, and about 35 vol %, and more particularly within a range between about 5.0 vol % and about 25 vol %.

Moreover, it will be appreciated that the mixture can include "natural porosity" or the existence of bubbles or pores within the mass of the mixture of abrasive grains, glass powder, and other additives. Accordingly, this natural porosity can be maintained in the final bonded abrasive article depending upon the forming techniques. As such, in particular embodiments, pore formers may not be used and the natural porosity within the mixture may be utilized and maintained throughout the forming and sintering process to form a final bonded abrasive article having the desired amount of porosity. Generally, the natural porosity of the mixture is not greater than about 40 vol %. Although, in particular embodiments the natural porosity within the mixture is less, such as not greater than about 25 vol %, or not greater than about 15 vol %. Generally, the amount of natural porosity within the mixture is within a range between about 5.0 vol % and about 25 vol %.

While the mixing step can include mixing the glass powder, abrasive grains and other components described above, according to a particular embodiment, the binder and the abrasive grains can be first mixed in the water. The water with the additional components (i.e., the abrasive grains and the binder) can then be combined with the glass powder, and if present, the pore former.

Referring again to FIG. 1, after mixing the glass powder with abrasive grains at step 103, the method continues at step 105, by forming the mixture to form a green article. Forming of the mixture into a green article can include forming processes that gives the green article the desired final contour or substantially the desired final contour. As used herein, the term "green article" refers to a piece that is not fully sintered. Accordingly, forming processes can include processes such as casting, molding, extruding, and pressing, or combinations thereof. According to a one embodiment, the forming process is a molding process.

After forming the green article, the process continues at step 107 and includes a pre-firing step. Generally the pre-firing step includes heating the green article to facilitating evolving volatiles (e.g., water and/or organic materials or pore formers). As such, heating of the mixture generally includes heating to a temperature of greater than about room temperature (22° C.). According to one embodiment, the pre-firing process includes heating the green article to a temperature of not less than about 100° C., such as not less than about 200° C., or even not less than about 300° C. According to a particular embodiment, heating is completed between a temperature of about 22° C. and about 850° C.

After pre-firing the green article at step 107, the process continues at step 109, by sintering the green article to a temperature of not less than about 1200° C., to form a densified bonded abrasive article having abrasive grains within a bond matrix. Notably, the green article is sintered at a temperature of not less than 1200° C., such that in one embodiment, sintering is carried out at a temperature not less than about 1250° C. More particularly sintering can be carried out at higher temperatures, such as not less than about 1300° C., or even not less than about 1350° C. Generally, sintering is carried out a temperature within a range between about 1200° C. and about 1600° C., and particularly within a temperature range between about 1300° C. and about 1500° C.

In addition to sintering at high temperatures, sintering is generally carried out in a controlled atmosphere. According to one embodiment, such as controlled atmosphere can include a non-oxidizing atmosphere. Examples of a non-oxidizing atmosphere can include an inert atmosphere, such as one using a noble gas. According to one particular embodiment, the atmosphere consists of nitrogen, such as not less than about 90 vol % nitrogen. Other embodiments utilize a greater concentration of nitrogen, such as not less than about 95 vol %, or even not less than 99.99 vol % of the atmosphere is nitrogen. According to one embodiment, the process of sintering in a nitrogen atmosphere begins with an initial evacuation of the ambient atmosphere to a reduced pressure of not greater than about 0.05 bar. In a particular embodiment, this process is repeated such that the sintering chamber is evacuated numerous times. After the evacuation, the sintering chamber can be purged with oxygen-free nitrogen gas.

In further reference to the sintering process, generally sintering is carried out for a particular duration. As such, sintering is generally carried out for a duration of not less than about 10 minutes, such as not less than about 60 minutes, or even not less than about 240 minutes at the sintering temperature. Generally, sintering is carried out for a duration between about 20 minutes to about 4 hours, and particularly between about 30 minutes and about 2 hours.

Referring again to FIG. 1, after the sintering step at 109, the process continues at step 111, which includes a controlled cooling and in some systems a controlled crystallization process. Generally, after sintering, the bonded abrasive article is processed through a controlled cooling. As such, the ramp rate from the sintering temperature can be controlled to facilitate crystallization of the bond matrix material. Typically the cooling rate from the sintering temperature is not greater than about 50° C./min, such as not greater than about 40° C./min, or even not greater than about 30° C./min. According to a particular embodiment, cooling is undertaken at a rate of not greater than about 20° C./min.

Additionally, the controlled cooling and crystallization process can include a hold process wherein the bonded abrasive article is held at a crystallization temperature above the glass transition temperature ($T_g$) of the bond matrix material. Typically, the bonded abrasive article can be cooled to a temperature of not less than about 100° C. above $T_g$, such as not less than about 200° C. above $T_g$, or even not less than about 300° C. above $T_g$. Generally, the crystallization temperature is not less than about 800° C., such as not less than about 900° C., or even not less than about 1000° C. Particularly, the crystallization temperature is within a range between about 900° C. to about 1300° C., and more particularly within a range between about 950° C. to about 1200° C.

During the controlled cooling and crystallization process, the bonded abrasive article is generally held at the crystallization temperature for a duration of not less than about 10 min. In one embodiment, the bonded abrasive article is held at the crystallization temperature for not less than about 20 min, such as not less than about 60 min, or even not less than about 2 hours. Typical durations for holding the bonded abrasive at the crystallization temperature are within a range between about 30 min to about 4 hours, and particularly within a range between about 1 hour to about 2 hours. It will be appreciated, that the atmosphere during this optional cooling and crystallization process is the same as the atmosphere during the sintering process and accordingly includes an controlled atmosphere, particularly an oxygen-free, nitrogen-rich atmosphere.

In the final formed bonded abrasive article, the abrasive grains generally comprise not less than about 25 vol % of the total volume of the bonded abrasive article. According to embodiments, the abrasive grains generally comprise not less than about 35 vol %, such as not less than about 45 vol %, or even not less than about 50 vol % of the total volume of the final formed bonded abrasive article. According to one particular embodiment, the abrasive grains comprise between about 35 vol % and about 60 vol % of the total volume of the final formed abrasive article.

Generally, the bond matrix is present in an amount of not greater than about 60 vol % of the total volume of the final formed bonded abrasive article. As such, the bonded abrasive generally includes not greater than about 50 vol % bond matrix, such as not greater than about 40 vol %, or even not greater than about 30 vol %. Accordingly, the bond matrix is generally present within an amount of between about 10 vol % and about 30 vol % of the total volume of the final formed bonded abrasive article.

It will be appreciated that the bond matrix includes those compounds and particularly the ratio of the compounds within the initial glass powder as described above. That is, the bond matrix comprises substantially the same composition as that of the glass powder, notably this includes metal oxide compounds, particularly complex metal oxide compounds, and more particularly silicate-based compositions, such as for example, an aluminum silicate, MAS, LAS, BAS, CMAS, or CBAS composition.

In further reference to the bond matrix, generally the bond matrix includes a polycrystalline ceramic phase, and particularly, the bond matrix includes not less than about 50 vol % polycrystalline ceramic phase. According to a particular embodiment, the bond matrix includes not less than about 75 vol % polycrystalline ceramic phase, such as not less than about 80 vol %, or even, not less than about 90 vol %. According to a particular embodiment, the bond matrix is comprised essentially of a polycrystalline ceramic phase. Typically, the polycrystalline ceramic phase of the bond matrix is present in an amount between about 60 vol % and about 100 vol %.

Generally, the polycrystalline ceramic phase includes a plurality of crystallites or crystalline grains which have an average size of not less than about 0.05 microns. In one particular embodiment, the average crystallite size is not less than about 1.0 microns, such as not less than about 10 microns, or even not less than about 20 microns. Still, the average crystallite size is generally not greater than about 100 microns, such that the average crystallite size is within a range between about 1.0 microns and 100 microns.

Generally, the composition of the crystallites of the polycrystalline ceramic phase can include silicon oxide, aluminum oxide, or a combination of both. As such, the crystallites of the polycrystalline ceramic phase can include crystals such as beta-quartz, which can incorporate other metal oxides incorporated in the initial glass powder, such as for example, $Li_2O$, $K_2O$, MgO, ZnO, and $Al_2O_3$, in a solid solution. In particular, the polycrystalline ceramic phase can include an aluminum silicate phase. According to another particular embodiment, the crystallites of the polycrystalline ceramic phase can include compound oxide crystals, such as for example, cordierite, enstatite, sapphirine, anorthite, celsian, diopside, spinel, and beta-spodumene, wherein the beta-spodumene in particular is found in a solid solution.

In addition to the polycrystalline ceramic phase, the bond matrix may also include an amorphous phase. The amorphous phase, like the polycrystalline ceramic phase, can include silicon oxide and aluminum oxide and additional metal oxide species that may be present within the original glass powder. Typically, the amorphous phase is present in an amount not greater than about 50 vol % of the total volume of the bond matrix. As such, an amorphous phase is generally present in a minority amount, such that it is present in an amount not greater than about 40 vol %, such as not greater than about 30 vol %, or less, such as not greater than about 15 vol %. According to a particular embodiment, an amorphous phase is present in an amount of between about 0 vol % to about 40 vol %, and more particularly within a range between about 5.0 vol % and about 20 vol %.

Moreover, the thermal expansion coefficient of the bond matrix material is typically low, such as, not greater than about $80\times10^{-7}/K^{-1}$. According to a particular embodiment, the bond matrix has a thermal expansion coefficient not greater than about $60\times10^{-7}/K^{-1}$, such as not greater than about $50\times10^{-7}/K^{-1}$, or even not greater than about $40\times10^{-7}/K^{-1}$. As such, the thermal expansion coefficient of the bond matrix is typically within a range of between about $10\times10^{-7}/K^{-1}$ and about $80\times10^{-7}/K^{-1}$.

The post-sintering polycrystalline bond matrix generally has a flexural strength of not less than about 80 MPa. In other embodiments, the flexural strength of the bond matrix is greater, such as not less than about 90 MPa, not less than about 100 MPa, or in some instances, not less than about 110 MPa. According to a particular embodiment, the flexural strength of the bond matrix is within a range of between about 90 MPa and about 150 MPa.

In addition to such characteristics, the post-sintering polycrystalline bond matrix generally has a toughness of not less than about 0.8 MPa $m^{1/2}$. In other embodiments, the toughness of the bond matrix can be greater, such as not less than about 1.5 MPa $m^{1/2}$, or even not less than about 2.0 MPa $m^{1/2}$.

As described in accordance with FIG. 1, the formation process generally includes adding pore formers, such that the final bonded abrasive article includes a certain degree of porosity. Accordingly, the bonded abrasive article generally includes a degree of porosity that is not less than about 5.0 vol % of the total volume of the bonded abrasive article. Typically, the amount of porosity is more, such that the porosity is not less than about 10 vol %, such as not less than about 15 vol %, about 20 vol %, or even, not less than about 30 vol % of the total volume of the bonded abrasive. Still, the amount of porosity is limited, such that the porosity is not greater than about 70 vol %, such as not greater than about 60 vol %, or even not greater than about 50 vol %. According to a particular embodiment, the porosity of the bonded abrasive article is within a range of between about 20 vol % and about 50 vol %. Such porosity is generally a combination of both open and closed porosity.

In further reference to the porosity of the bonded abrasive article, the average pore size is generally not greater than about 500 microns. In one embodiment, the average pore size is not greater than about 250 microns, such as not greater than about 100 microns, or even not greater than 75 microns. According to a particular embodiment, the average pore size is within a range between about 1.0 microns and about 500 microns, and particularly within a range between about 10 microns and about 250 microns.

In reference to properties of the bonded abrasive article, generally the formed bonded abrasive article has a modulus of rupture (MOR) of not less than about 20 MPa. However, the MOR can be greater, such as not less than about 30 MPa, or not less than about 40 MPa, such as not less than about 50 MPa, or even not less than about 60 MPa. In one particular embodiment, the MOR of the bonded abrasive article is not less than about 70 MPa, and is typically within a range of between about 50 MPa and about 150 MPa.

In further reference to properties of the bonded abrasive articles, according to one embodiment, the abrasive articles have a modulus of elasticity (MOE) of not less than about 40 GPa. In another embodiment, the MOE is not less than about 80 GPa, such as not less than about 100 GPa, and even not less than about 140 GPa. Generally, the MOE of the bonded abrasive article is within a range of between about 40 GPa and about 200 GPa, and particularly within a range between about 60 GPa and about 140 GPa.

Figure 2A:
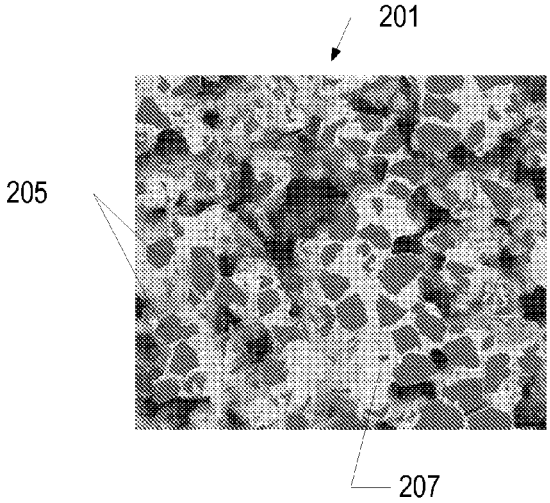
FIGS. 2*a*-2*b* are two micrograph images illustrating portions of a bonded abrasive article according to one embodiment.

Referring to FIG. 2*a*, a first image 201 is illustrated which includes a portion of a bonded abrasive according to one embodiment. The first image 201 illustrates abrasive grains 205 within a bond matrix 207. In particular, the bonded abrasive article illustrated in FIG. 2*a* was sintered at 1320° C. for a duration of 60 minutes. Notably, the first image 201 illustrates the bond matrix 207 is a substantially uniform phase, superior wetting between the bond matrix 207 and the abrasive grains 205, which in turn demonstrates significant bonding between the bond matrix 207 and the abrasive grains 205.

Figure 2B:
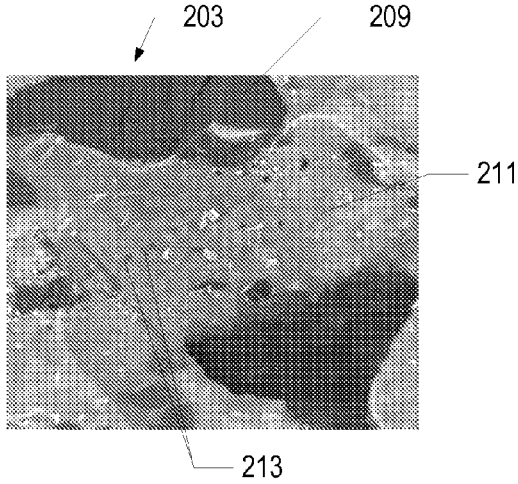

FIG. 2*b* further illustrates a second image 203 of a portion of a bonded abrasive according to one embodiment. Notably the second image 203 is a magnified image as compared to the first image 201 and illustrates an abrasive grain 209 within a bond matrix 211. As illustrated in the magnified second image 203, the bond matrix 211 includes a crystalline phase, and particularly exhibits a plurality of crystalline grains 213 which form the polycrystalline ceramic phase of the bond matrix.

Figure 3A:
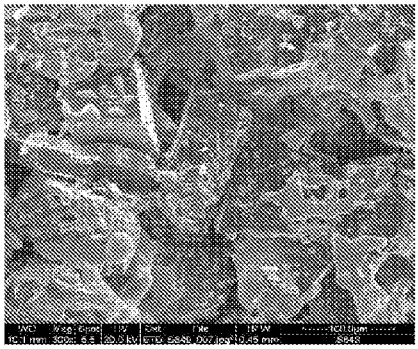
FIG. 3*a*-3*e* are five micrograph images illustrating portions of bonded abrasive articles, each of the portions illustrated are taken from bonded abrasive articles fired at different temperatures.
Figure 3B:
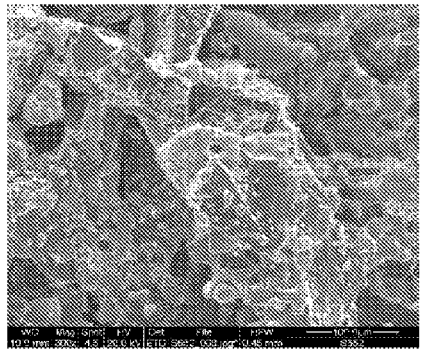
Figure 3C:
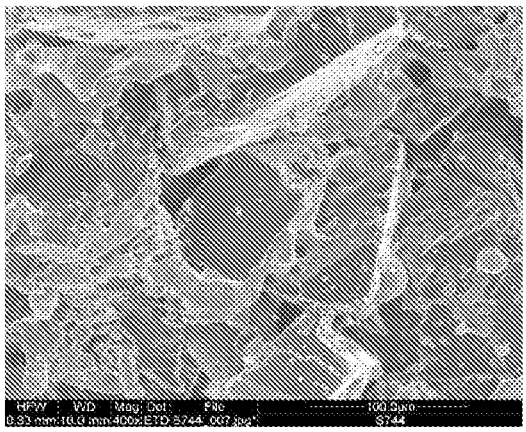
Figure 3D:
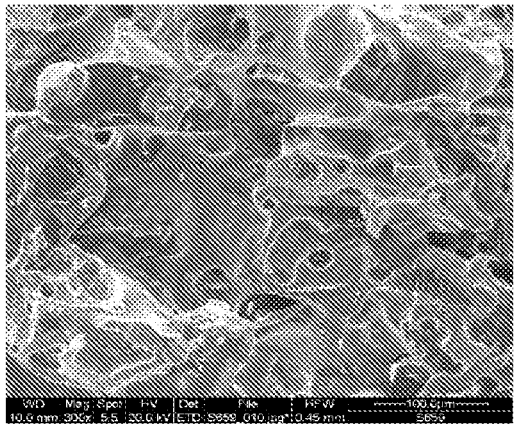
Figure 3E:
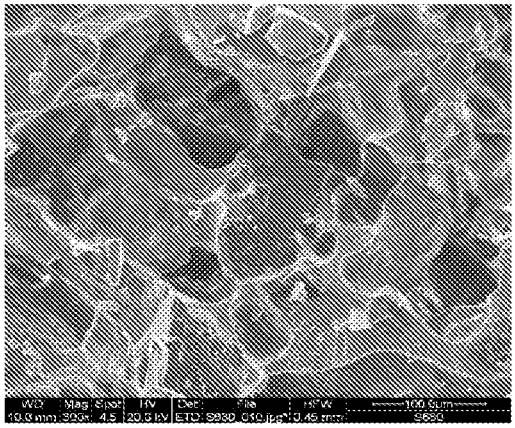

Referring to FIGS. 3*a*-3*e*, five micrographs are provided which illustrate portions of bonded abrasive articles, wherein each of the bonded abrasive articles has been sintered at a different temperature. FIG. 3*a* illustrates a portion of a bonded abrasive article sintered at 950° C. for 60 minutes. FIG. 3*b* illustrates a bonded abrasive article sintered at 980° C. for 60 minutes. FIG. 3*c* illustrates a bonded abrasive article sintered at 1060° C. for 60 minutes. FIG. 3*d* illustrates a portion of a bonded abrasive article sintered at 1200° C. for 60 minutes. FIG. 3*e* illustrates a portion of a bonded abrasive article sintered at 1340° C. for 60 minutes. As illustrated, the portions of the bonded abrasive articles fired at lower temperatures, notably FIGS. 3*a*-3*c*, illustrate a bond matrix that is not coalesced, non-uniform, and dispersed in small droplets across the abrasive grains which indicates poor wetting of the bond matrix on the abrasive grains. Alternatively, the bonded abrasive articles sintered at elevated temperatures, particularly FIGS. 3*d* and 3*e*, exhibit a bond matrix which has improved coalescence, increased uniformity and connectivity within the bond matrix and superior wetting of the abrasive grains.

Figure 4:
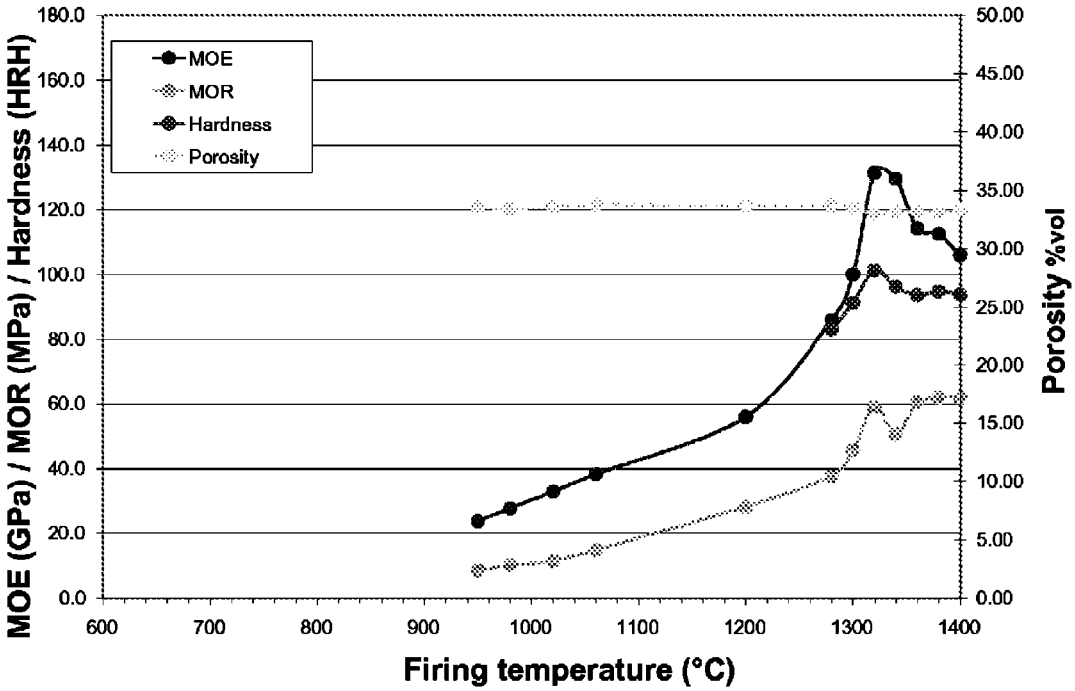
FIG. 4 is a plot illustrating properties of a bonded abrasive as a function of firing temperature according to one embodiment.

Referring to FIG. 4, a graph is provided which illustrates a plot of characteristics of bonded abrasive articles formed according to embodiments disclosed herein. In particular, FIG. 4 illustrates the modulus of elasticity (MOE), modulus of rupture (MOR), hardness, and porosity of bonded abrasive articles as a function of the sintering temperature. As illustrated, each of the samples prepared have substantially the same porosity, such that the porosity is about 34 vol %. Moreover, each of the samples were formed having the same bond matrix composition, such that the bond matrix comprised about 45 wt % $SiO_2$, about 28 wt % $Al_2O_3$, 14 wt % MgO, about 5.0 wt % $B_2O_3$, about 8.0 wt % $TiO_2$. Accordingly, each of the samples included about 16 vol % bond matrix, 34 vol % porosity and about 50 vol % abrasive grains.

In reference to the modulus of elasticity (MOE), FIG. 4 illustrates a general trend, that is, as the sintering temperature increases, the modulus of elasticity increases. In particular, as illustrated, at a sintering temperature of about 950° C. the modulus of elasticity is about 25 GPa. However, as sintering temperature increases, the modulus of elasticity increases such that at about 1320° C. the modulus of elasticity is almost 130 GPa. FIG. 4 further illustrates another trend with respect to the MOE, notably that the MOE decreases for samples sintered at temperatures in excess of about 1340° C.

With respect to the hardness of the bonded abrasive articles as a function of sintering temperature, generally the hardness of the bonded abrasive articles increases as the sintering temperature increases with a relatively constant level of porosity. As illustrated, at a sintering temperature of about 1280° C. the hardness is about 82 on the Rockwell Hardness H scale. As sintering temperature increases to a temperature of about 1320° C., the hardness increases to a value over 100. Measurements of hardness below 1280° C. were not completed as the bonded abrasive article was too soft for accurate measurements. FIG. 4 further illustrates the hardness value of the bonded abrasive article is illustrated as decreasing after sintering at temperatures in excess of 1320° C.

In reference to the modulus of rupture (MOR), generally the MOR values increase with increasing sintering temperatures. Notably, at a sintering temperature of about 950° C., the MOR is about 10 MPa, however with increasing sintering temperatures, the modulus of rupture increases. As such, at a sintering temperature above 1300° C., the bonded abrasive article has an MOR in excess of 50, such that at a sintering temperature of 1360° C. the MOR is above 60 MPa.

EXAMPLES

The following provides particular examples of bonded abrasive articles formed according to embodiments provided herein in contrast to a comparative sample bonded abrasive article. Table 1 below illustrates glass powder compositions (wt %), otherwise bond matrix compositions, of eight samples (Samples 1-8) formed according to embodiments described herein.

TABLE 1

| | $SiO_2$ | $Fe_2O_3$ | $Al_2O_3$ | CaO | MgO | $Li_2O$ | $Na_2O$ | $K_2O$ | $Cs_2O$ | BaO | $B_2O_3$ | $TiO_2$ | $Zr_2O$ | $P_2O_5$ | ZnO |
|---|---|---|---|---|---|---|---|---|---|---|---|---|---|---|---|
| Sample 1 | 69.3 | 0.11 | 9.56 | 0.96 | 2.89 | 7.26 | 0.66 | 0.66 | 1.82 | | 1.50 | 4.60 | | 1.39 | |
| Sample 2 | 48.5 | 0.20 | 28.9 | 0.09 | 12.1 | | 0.07 | 0.02 | | | 2.48 | 7.75 | 0.14 | | |
| Sample 3 | 53.2 | 0.02 | 19.4 | 1.00 | 22.6 | | 0.08 | | | | 2.07 | 0.04 | | 1.26 | |
| Sample 4 | 55.7 | 0.02 | 19.6 | 0.85 | 21.7 | | 0.90 | | | | | 0.05 | | 1.14 | |
| Sample 5 | 44.7 | 0.02 | 27.9 | 0.05 | 14.3 | | 0.10 | | | | 4.85 | 7.90 | | | |
| Sample 6 | 53.2 | 0.02 | 19.3 | 1.05 | 21.2 | | 1.20 | 0.01 | | | 3.00 | 0.02 | | | |
| Sample 7 | 55.7 | 0.02 | 17.5 | 0.30 | 19.6 | | 0.17 | 0.09 | | | 2.90 | 3.73 | | | |
| Sample 8 | 46.1 | 0.02 | 24.7 | 0.09 | 7.50 | | 0.01 | | 8.70 | | 3.50 | | | | 9.20 |
| Comparative Sample | 50.8 | 0.10 | 18.9 | 0.15 | 18.8 | | 0.03 | | | | 5.36 | 0.02 | | | 5.93 |

Each of the glass compositions was milled to a powder having an average particle size of about 12 microns and a high amorphous phase content of about 100 vol %. The glass powder was then combined with cubic boron nitride abrasive grains having an average grain size of about 115 microns. The mixture included 50 vol % cubic boron nitride abrasive grains and 16 vol % of the glass powder. Generally, each of the mixtures also included additives in amounts of 15 vol % water and 5.0 vol % of polyethylene glycol for use as a binder. The mixture also included about 14 vol % natural porosity.

The samples were then formed into green articles by molding the mixture using a compression mold. After forming, the green articles were pre-fired to a temperature of about 850° C. to evolve organics and low-volatility species and aid in forming the final bonded abrasive article.

After the pre-firing process, the green articles were sintered. Sample 1 was sintered at a temperature of 1000° C. for 4 hours. Otherwise, Samples 2-8 were sintered at elevated temperatures typically between 1320° C. and 1380° C. for 60 minutes, in a nitrogen-rich atmosphere at about 1.1 atm. Each of Samples 1-8 were cooled at a rate of between 8.0° C./min and 13° C./min. The Comparative Sample was sintered at a temperature of 1050° C. for about 60 minutes in a nitrogen-rich atmosphere. All samples had approximately 34 vol % porosity, 16 vol % bond matrix, and 50 vol % abrasive grains.

Figure 5:
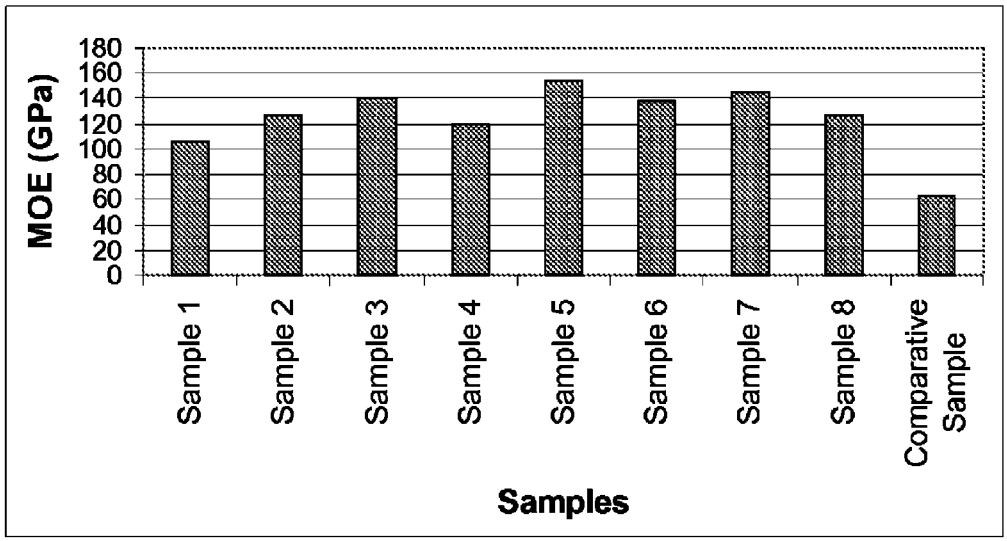
FIG. 5 is a plot illustrating the modulus of elasticity (MOE) of bonded abrasive articles formed according to embodiments herein.

Referring to FIG. 5, a plot is provided which illustrates the modulus of elasticity for Samples 1-8 and the Comparative Sample. As illustrated by the plot of FIG. 5, Samples 1-8 demonstrate an improved modulus of elasticity over the comparative sample. Each of Samples 1-8 demonstrate a modulus of elasticity in excess of 100 GPa, and typically at least 120 GPa, and in some instances in excess of 140 GPa. By comparison, the Comparative Sample has a modulus of elasticity of approximately 63 GPa.

Figure 6:
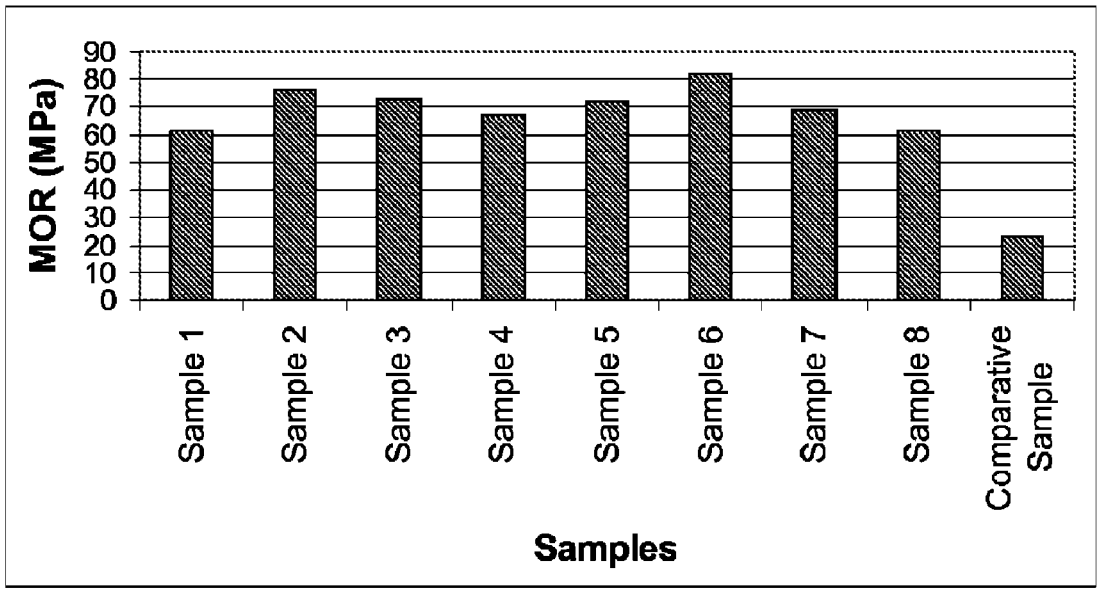
FIG. 6 is a plot illustrating the modulus of rupture (MOR) of bonded abrasive articles formed according to embodiments herein.

Referring to FIG. 6, a plot is illustrated which provides the modulus of rupture of Samples 1-8 and the Comparative Sample. Generally, the bonded abrasive articles of Samples 1-8 demonstrate an improved modulus of rupture over that of the Comparative Sample. Notably, Samples 1-8 have a modulus of rupture greater than about 60 MPa, while the Comparative Sample has a modulus of rupture of 23 MPa. Moreover, a majority of the Samples 1-8 have a modulus of rupture greater than 65 MPa, and some exhibit a modulus of rupture in excess of 70 MPa.

Figure 7:
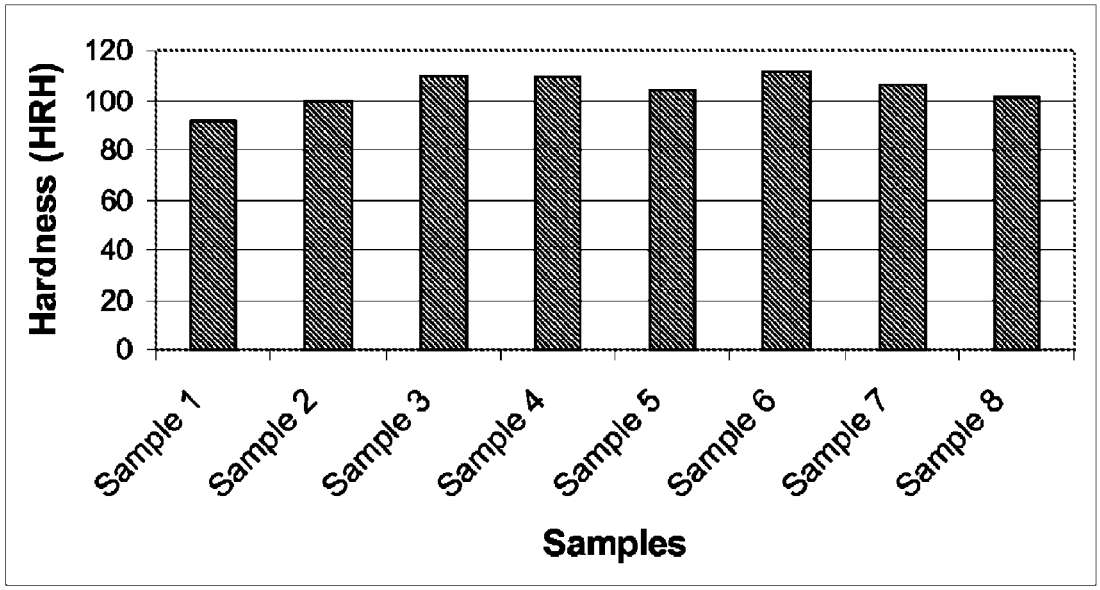
FIG. 7 is a plot illustrating the hardness of bonded abrasive articles formed according to embodiments herein.

Referring to FIG. 7, a plot is provided which illustrates the hardness of the bonded abrasive samples. Notably, each of Samples 1-8 demonstrate a hardness greater than that of the Comparative Sample. Particularly, Samples 1-8 illustrate a hardness of greater than 80 (Rockwell Hardness H Scale), and typically a hardness in excess of 90, and some samples exhibit a hardness of greater than 100. The hardness of the Comparative Sample was not measured as it was too soft, however, it is expected that the hardness was less than 70.

Generally, the bonded abrasive articles provided herein exhibit improved grinding performance, particularly improved wear. Accordingly, the present bonded abrasive articles exhibit an improvement in wear that is not less than about 5.0%, or even not less than about 10% as compared to comparative samples made according to other techniques.

Figure 8:
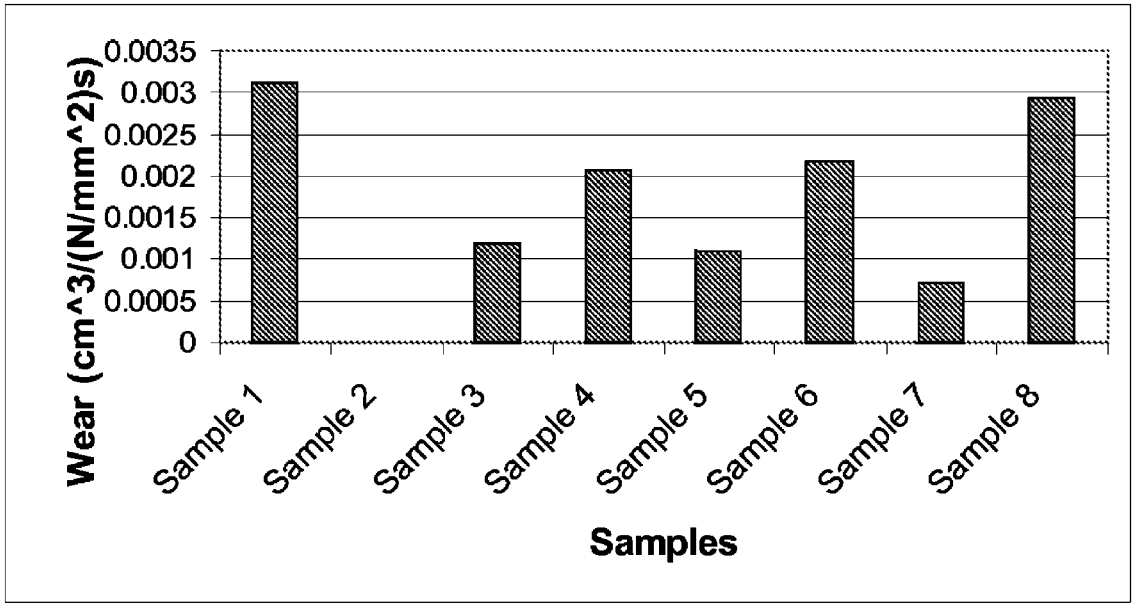
FIG. 8 is a plot illustrating the wear of bonded abrasive articles formed according to embodiments herein.

FIG. 8 illustrates wear values ($cm^3/(N/mm^2)s$) for Samples 1 and 3-8, provided in Table 1. The illustrated wear data for Samples 1, and 3-8 were obtained by carrying out the following test procedure. Each of the tested samples was subject to a grinding process utilizing a SiC coated abrasive (100 mesh). Each sample was subject to 10 second grinding cycles at an initial load of 10 N, and increasing at 10 N increments up to 50 N (i.e., 20N, 30N, 40N, and 50N). Each sample was subject to three grinding cycles for each load and the SiC coated abrasive pad was changed for each cycle. After each grinding cycle, the length loss and weight loss of the samples was recorded and average wear values for each of the samples was calculated. As illustrated, the wear data indicates that bonded abrasive articles formed according embodiments herein have improved grinding performance and particularly improved wear values.

According to embodiments herein, bonded abrasive articles are provided that have improved properties. While certain references disclose the formation of a bonded abrasive article having a crystalline bond matrix, such disclosures are limited by their bond matrix compositions, forming processes, the low porosity articles and the absence of cubic born nitride. Conventional bonded abrasives typically add fluxes to the bond matrix composition to lower the necessary sintering temperature. Lower sintering temperatures are thought to be advantageous for cost, efficiency, and reduced degradation of the bonded abrasive components, namely the abrasive grains. In contrast, the processes herein utilize a combination of different features including bond matrix compositions, sintering temperatures, controlled cooling and crystallization treatment, and atmosphere. Moreover, the final formed bonded abrasive articles herein have high porosity, superior wetting between the bond and abrasive grains, high crystalline content in the bond matrix, and improved strength and hardness.

While the invention has been illustrated and described in the context of specific embodiments, it is not intended to be limited to the details shown, since various modifications and substitutions can be made without departing in any way from the scope of the present invention. For example, additional or equivalent substitutes can be provided and additional or equivalent production steps can be employed. As such, further modifications and equivalents of the invention herein disclosed may occur to persons skilled in the art using no more than routine experimentation, and all such modifications and equivalents are believed to be within the scope of the invention as defined by the following claims.

What is claimed is:

1. An bonded abrasive comprising:

abrasive grains within a bond matrix, the abrasive grains comprising cubic boron nitride (cBN) and the bond matrix comprising a polycrystalline ceramic phase, the bonded abrasive further comprising a porosity of not less than about 5.0 vol % and a modulus of rupture (MOR) of not less than about 50 MPa.

2. The bonded abrasive of claim 1, wherein the bond matrix comprises silicon oxide.

3. The bonded abrasive of claim 2, wherein the bond matrix comprises not less than about 20 mol % silicon oxide.

4. The bonded abrasive of claim 2, wherein the bond matrix comprises aluminum oxide.

5. The bonded abrasive of claim 4, wherein the bond matrix further comprises at least one element selected from the group of elements consisting of lithium oxide, magnesium oxide, calcium oxide, barium oxide, sodium oxide, potassium oxide, boron oxide, zirconium oxide, titanium oxide, zinc oxide, yttrium oxide, iron oxide, cesium oxide, lanthanum oxide, and bismuth oxide.

6. The bonded abrasive of claim 5, wherein the bond matrix comprises silicon oxide in an amount between about 40 mol % and about 60 mol %, aluminum oxide in an amount within a range between about 10 mol % and about 30 mol %, and magnesium oxide in an amount within a range between about 15 mol % and about 35 mol %.

7. The bonded abrasive of claim 1, wherein the bond matrix comprises not less than about 50 vol % of the polycrystalline ceramic phase.

8. The bonded abrasive of claim 1, wherein polycrystalline ceramic comprises crystallites having an average crystallite size of not less than about 0.05 microns.

9. The bonded abrasive of claim 1, wherein the porosity has an average pore size of not greater than about 500 microns.

10. The bonded abrasive of claim 1, wherein the MOR is within a range of between about 50 MPa and about 150 MPa.

11. A bonded abrasive comprising:

abrasive grains within a bond matrix, the abrasive grains comprising cubic boron nitride (cBN) and the bond matrix comprising a polycrystalline ceramic phase, the bonded abrasive further comprising a porosity of not less than about 20 vol % and a modulus of rupture (MOR) of not less than about 50 MPa.

* * * * *